US006373479B1

(12) United States Patent
Moon

(10) Patent No.: US 6,373,479 B1
(45) Date of Patent: Apr. 16, 2002

(54) POWER SUPPLY APPARATUS OF AN LCD AND VOLTAGE SEQUENCE CONTROL METHOD

(75) Inventor: Seung-hwan Moon, Seoul (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/263,782

(22) Filed: Mar. 5, 1999

(30) Foreign Application Priority Data

Oct. 16, 1998 (KR) ..... 98-43289
Dec. 1, 1998 (KR) ..... 98-52226

(51) Int. Cl.[7] ..... G09G 5/00

(52) U.S. Cl. ..... 345/211; 345/212; 345/213; 345/214; 363/65; 323/223; 323/217; 307/71; 307/82

(58) Field of Search ..... 345/211–214; 363/65; 323/217, 223; 307/82, 71

(56) References Cited

U.S. PATENT DOCUMENTS 5,550,729 A * 8/1996 Wissell ..... 363/65
5,625,387 A * 4/1997 Moon ..... 345/211
5,745,092 A * 4/1998 Ito ..... 345/95
5,760,759 A * 6/1998 Tanaka et al. ..... 345/95
5,777,611 A * 7/1998 Song ..... 345/212
5,940,069 A * 8/1999 Moon ..... 345/211
5,945,970 A * 8/1999 Moon et al. ..... 345/92
6,049,228 A * 4/2000 Moon ..... 326/81
6,219,016 B1 * 4/2001 Lee ..... 345/87

* cited by examiner

*Primary Examiner*—Almis R. Jankus
*Assistant Examiner*—Henry N. Tran
(74) *Attorney, Agent, or Firm*—McGuireWoods LLP

(57) ABSTRACT

A power supply for an LCD and a voltage sequence control method in which the sequence for voltages applied to a gate driver IC for outputting a driving voltage of an LCD panel is controlled by arranging a switching element between a DC-to-DC converter and the gate driver IC so as to switch a turn-on voltage to a turn-off voltage to be applied to the gate driver IC, and a latch up is prevented by arranging diodes in reverse and forward directions to the lines for applying the turn-on and turn-off voltages respectively so that the applied voltage is not deviated from the latch up preventing scope. Voltages are applied or removed from the gate driver IC in accordance with a predetermined sequence, and an abnormal voltage is prevented from being applied in an early stage of driving, to thereby stabilize the LCD panel operation.

18 Claims, 3 Drawing Sheets

POWER SUPPLY APPARATUS OF AN LCD AND VOLTAGE SEQUENCE CONTROL METHOD

BACKGROUND OF THE INVENTION (a) Field of the Invention

The present invention relates to a liquid crystal display (LCD) device, and more particularly, to a power supply of an LCD and voltage sequence control methods that enhance the LCD panel performance and prevent a latch up by applying stabilized voltages to the gate driver integrated circuits (ICs). The voltage sequence is determined by the turn-off voltage level among voltage levels applied to a gate driver IC that outputs a driving voltage for the panel.

(b) Description of the Related Art

Generally, LCD devices include an LCD panel where a liquid is injected between the two glass substrates on which pixels and electrodes are formed, a printed circuit board (PCB) where various integrated circuits for driving the LCD panel are mounted and interfacing with the electrode of the LCD panel, a back light unit providing the display with required light, a power supply providing various driving voltages, and an assembly of mold frames or chassis.

A predetermined voltage level applied to the LCD panel, operates a thin film transistor (TFT) that constitutes each pixel to display a certain image.

Controlling the voltage applied to display the desired image is considerably important in LCD display technologies. U.S. Pat. No. 5,777,611 discloses an apparatus for controlling power sequence of an LCD module.

Specifically, a plurality of voltages are applied in a predetermined sequence to a plurality of gate driver ICs mounted on the PCB, and each gate driver IC outputs a voltage to drive the LCD panel.

In a conventional method, as shown in FIG. 1, a turn-on voltage $V_{on}$ with approximately 20V and a turn-off voltage $V_{off}$ with approximately −7V are applied to a driver IC 3. Such voltages are applied or removed in accordance with a predetermined sequence. An incorrectly controlled sequence causes a latch up, which may result in a failure in driving the LCD panel. Here the driver IC 3 is a gate driver IC.

Voltages $V_{on}$ and $V_{off}$ are generated by applying a constant voltage $V_{DD}$ to a DC-to-DC converter.

Generally, the sequence for applying a voltage to a driver IC is set in such a manner that $V_{off}$ voltage is applied first and $V_{on}$ voltage later when the device is turned on, and $V_{on}$ voltage is applied first and $V_{off}$ voltage later when the device is turned off.

If necessary, an LCD device includes a power sequence controlling circuit. $V_{on}$ voltage and $V_{off}$ voltage are generated independently from each other in a conventional power sequence controlling circuit. A sequence of such voltages is controlled by time constants of a plurality of DC-to-DC converters 1 and 2 for outputting $V_{on}$ voltage and $V_{off}$ voltage, or only by a time constant of $V_{on}$ voltage.

However, in the above-described sequence control method, $V_{on}$ voltage and $V_{off}$ voltage are applied to a driver IC independently from each other. Thus, a relative time control for keeping the sequence is difficult to achieve. Specifically, the above-described conventional method allows a sequence control only when a power is turned on.

Accordingly, as shown in FIG. 2 the voltage applying sequence of the driver IC 3 is not followed correctly, which causes a latch up. This may result in a failure in driving an LCD panel 4.

In the meantime, a latch up may occur while controlling the voltage applying sequence, by failing to keep the voltage level applied to the driver ICs.

In more detail, after voltage $V_{DD}$ is applied in accordance with the normal sequence, voltage $V_{off}$ of approximately −7V and voltage $V_{on}$ of approximately 20V are applied to the driver IC as a reference voltage for controlling a TFT. However, a current may flow to the path for applying voltage $V_{on}$ or $V_{off}$ before the voltages of $V_{on}$ and $V_{off}$ are stabilized to the level of −7V and 20V respectively. Thus, due to such a current, a voltage exceeding the scope of −0.5V of $V_{off}$ (and 0.5V for $V_{on}$), a requisite for preventing latch up of the driver IC, is applied to the driver IC. As a result, an excessive current is generated to the CMOS (complementary metal-oxide semiconductor) circuit which constitutes the driver IC. Thus, the DC-to-DC converter is shut down due to an excessive current applied thereto, which impedes driving of the LCD module.

SUMMARY OF THE INVENTION

It is therefore an object of the present invention to apply a plurality of voltages to a driver IC for outputting a driving voltage of an LCD panel in accordance with a predetermined sequence by allowing the plurality of voltages to be dependent upon each other.

It is another object of the present invention to stabilize driving of the LCD panel by applying the voltages to the driver IC in accordance with a predetermined sequence.

It is still another object of the present invention to provide a normal operation of the LCD panel by stabilizing the driving voltage applied to the driver IC and preventing a latch up of the driver IC.

To achieve the above objects and other advantages, there is provided a power supply of an LCD including a first and a second DC-to-DC converters for converting a constant voltage and outputting a first and a second voltages which are different from each other, a switching device for switching the first voltage based on a level of the second voltage and outputting a converted third voltage and a gate driver integrated circuit (IC) for determining the second voltage as a turn-off voltage and the third voltage as a turn-on voltage and outputting a signal for driving an LCD panel.

The switching device consists of a switching element and voltage dividing resistances connected thereto. A pnp-type bipolar transistor or a p-type MOS transistor can be used as the switching element.

For the pnp-type bipolar transistor, a potential difference caused by the voltage dividing resistance is required to be set higher than those between an emitter and a base. For the p-type MOS transistor, the potential difference caused by the voltage dividing resistance is required to be set higher than a threshold voltage.

The voltage sequence according to the above-described constitution is controlled by applying voltages for turning on and off the LCD panel to a driver IC for outputting on and off signals for driving the LCD panel. In addition, the level of the turn-off voltage switches to control the level and time for applying the voltage for turning on the LCD panel.

Accordingly, when an external power is applied to the LCD panel, the voltage for turning on the LCD panel is applied after the voltage for turning off the LCD panel is applied to the driver IC. When the external power is turned off, the turn-on voltage level is removed prior to the removal of the turn-off voltage level and these sequences are controlled automatically.

The present invention may use as a latch up preventive device a first diode connected in forward direction to a portion of the driver IC to which the first voltage is applied, and a second diode connected in reverse direction to a portion of the driver IC to which the second voltage is applied.

BRIEF DESCRIPTION OF THE DRAWINGS

The above object and other advantages of the present invention will become more apparent by describing in detail the preferred embodiments thereof with reference to the accompanying drawings, in which.

DETAILED DESCRIPTION OF THE PREFERRED EMBODIMENTS

The present invention now will be described more fully hereinafter with reference to the accompanying drawings, in which preferred embodiments of the invention are shown. This invention may, however, be embodied in many different forms and should not be construed as limited to the embodiments set forth herein.

Figure 1:
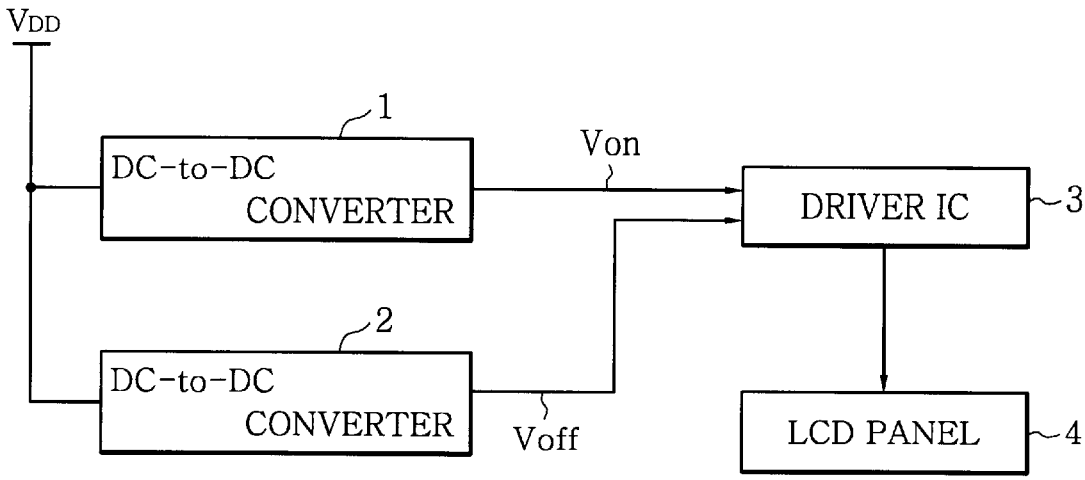
FIG. 1 (Prior Art)
FIG. 1 is a block diagram showing a conventional power supply of an LCD.
Figure 2:
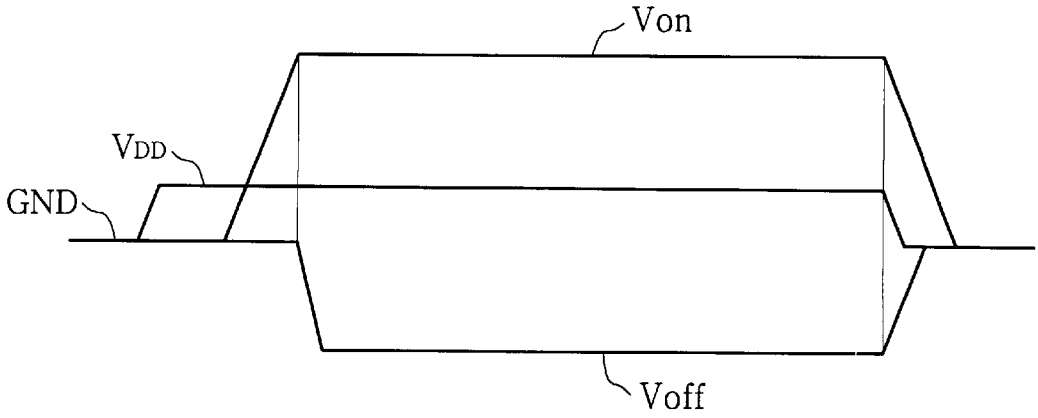
FIG. 2 (Prior Art)
FIG. 2 illustrates a voltage sequence error of the conventional power supply of an LCD.
Figure 3:
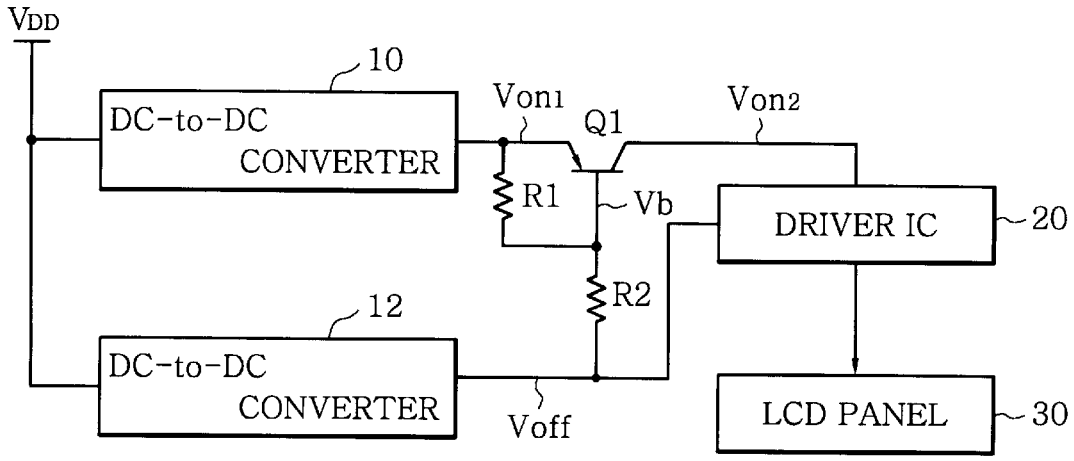
FIG. 3 is a block diagram showing a power supply apparatus of an LCD according to a first embodiment of the present invention.

Referring to FIG. 3, a power supply apparatus of a first embodiment of the present invention includes DC-to-DC converters 10 and 12 to which the constant voltage $V_{DD}$, i.e., an external input power having a predetermined level, is applied. The DC-to-DC converter 10 outputs a turn-on voltage $V_{on\ 1}$ while the DC-to-DC converter 12 outputs a turn-off voltage $V_{off}$.

An output terminal of the DC-to-DC converter 10 is connected to an emitter of a transistor Q1, a resistance R1 is connected between the emitter and a base of the transistor Q1, and a collector of the transistor Q1 is connected to a first input terminal of a driver IC 20. Here, a turn-on voltage $V_{on2}$ that appears at the collector when the transistor Q1 is turned on, is applied to the first input terminal of the driver IC 20.

An output terminal of the DC-to-DC converter 12 is connected to a second input terminal of the driver IC 20 so that the turn-off voltage $V_{off}$ can be applied. In addition, a node connected to the base of the transistor Q1 via a resistance R2 is formed between the second input terminal of the driver IC 20 and the output terminal of the DC-to-DC converter 12. A node connected to the resistance R1 is formed between the resistance R2 and the base of the transistor Q1. Here, the voltage applied to the base of the transistor Q1 is called $V_b$.

Preferably, the transistor Q1 used as a switching device is a pnp-type bipolar transistor. Resistances R1 and R2 are for dividing the potential difference between the turn-on voltage $V_{on1}$ and the turn-off voltage $V_{off}$. The ratio between the two resistances is determined with reference to the following equation which shows a voltage applied to $$\frac{R11}{R11+R22}\times(V_{on1}-V_{off})>V_{eb}$$

the resistance R1 between the emitter and the base.

Wherein, R11 and R22 indicate values of the resistances R1, R2, and $V_{eb}$ is a constant representing a voltage drop between the emitter and the base of the transistor Q1.

That is, resistance values R11 and R22 can be set within the scope that satisfies the above-described equation. The potential difference applied to the emitter and the base of the transistor Q1, i.e., the difference ('T' as shown in FIG. 4) between the turn-on voltage $V_{on}$ and the base applying voltage $V_b$, is required to be set higher than the voltage drop value $V_{eb}$ between the collector and the base of the transistor Q1.

The driver IC 20 is structured in a way that an on/off signal for driving an LCD panel 30 is generated by the turn-on voltage $V_{on2}$ and turn-off voltage $V_{off}$ which are applied to the first and second input terminals thereof, and applied to the LCD panel 30.

In the first embodiment of the present invention, a sequence for a normal operation of the driver IC 20 is as follows. When the constant voltage $V_{DD}$, i.e., a main power, is applied, the turn-off voltage $V_{off}$ applied to the driver IC 20 is generated prior to the generation of the turn-on voltage $V_{on2}$. When the constant voltage $V_{DD}$ is dropped down to a ground level, the turn-on voltage $V_{on2}$ applied to the driver IC 20 is removed prior to the removal of the turn-off voltage $V_{off}$.

Figure 4:
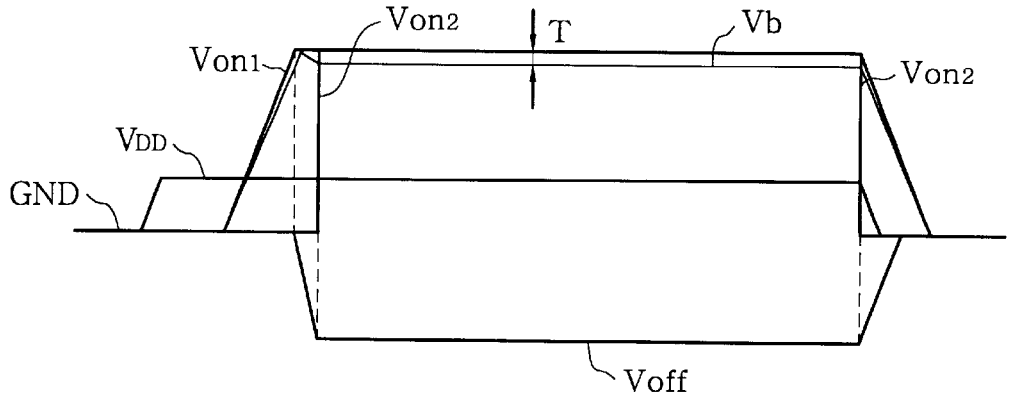
FIG. 4 illustrates a voltage sequence of an LCD according to the present invention.

The first embodiment of the present invention considering such a sequence is shown in FIG. 3, and its voltage applying sequence is shown in FIG. 4.

An operation of the first embodiment of the present invention can be explained with reference to FIGS. 3 and 4.

The driver IC 20 converts the voltage in accordance with the turn-on voltage $V_{on2}$ and the turn-off voltage $V_{off}$ inputted from the first and second input terminals and applies the converted voltage to the LCD panel 30.

When $V_{DD}$ of a high level is applied to each input terminal of DC-to-DC converters 10 and 12 of a low level, i.e., a ground level ("GND" as shown in FIG. 4), the DC-to-DC converter 10 outputs the voltage $V_{on1}$ while the DC-to-DC converter 12 outputs the turn-off voltage $V_{off}$.

The DC-to-DC converter 10 has a time constant smaller than that of the DC-to-DC converter 12. Therefore, the voltage $V_{on1}$ is output prior to the output of turn-off voltage $V_{off}$.

The voltage $V_b$ applied to the base of the transistor Q1 after its voltage is divided by resistances R1 and R2, is raised to a high level, while the voltage $V_{on1}$ is being raised to a predetermined high level (approximately 20V).

In the meantime, the turn-off voltage $V_{off}$ is output from the DC-to-DC converter 12, and in parallel applied to the driver IC 20 and to the resistance R2 connected to the transistor Q1. Here, the turn-off voltage $V_{off}$ is lowered to a predetermined level (approximately, −7V), and the voltage $V_b$ goes down to a predetermined level. The transistor Q1 is turned on for switching when the turn-off voltage $V_{off}$ is lowered to a predetermined level (approximately, −7V).

When the transistor Q1 is turned on, the turn-on voltage $V_{on2}$ with a predetermined level is applied from the collector of the transistor Q1 to the driver IC 20.

In the first embodiment of the present invention, the turn-on voltage $V_{off}$ is applied to the driver IC 20 first when the constant voltage $V_{DD}$, a power source, is turned on. Then, if the turn-off voltage $V_{off}$ reaches a predetermined level, the turn-on voltage $V_{on\,2}$ generated by switching of the transistor Q1 is applied to the driver IC 20.

When the constant voltage $V_{DD}$ drops down to the ground level GND, level of each voltage also drops to the ground level GND at the same time. When the turn-off voltage $V_{off}$ goes out of the switching level, the transistor Q1 is immediately turned off. Therefore, the turn-on voltage $V_{on2}$ applied to the driver IC 20 first drops down to the ground level GND, and is removed. Then, after a predetermined time period, the turn-off voltage $V_{off}$ rises up to the ground level GND, and is removed. Then, the turn-on voltage and the base applying voltage $V_b$ of the transistor Q1 having a potential difference relatively higher than that of the turn-off voltage $V_{off}$, drop down to the ground level GND, and are removed.

Accordingly, in the first embodiment of the present invention, when the constant voltage $V_{DD}$ is turned off, the turn-on voltage $V_{on2}$ applied to the driver IC 20 is removed prior to the removal of the turn-off voltage $V_{off}$.

Voltages are applied to the gate driver IC 20 when the power is turned on, and voltages are removed when the power is turned off, in accordance with a prearranged sequence, which is caused by a switching operation of the transistor Q1.

The transistor Q1 is switched in accordance with the level of the turn-off voltage $V_{off}$ applied to the base. As a result, sequences of the voltages applied to the driver IC 20 are determined by the turn-off voltage as a reference voltage.

In the first embodiment of the present invention, the switching device consists of a pnp-type bipolar transistor and voltage dividing resistances. However, a p-type MOS transistor and resistances may constitute the switching device.

For the p-type MOS transistor, the potential difference between the emitter and the base is required to be higher than the absolute value of the threshold voltage $V_{th}$.

The present invention concerns the control of the sequence of the voltage supplied to the driver IC that applies a driving voltage to the LCD panel, by means of a switching method. Either the turn-on voltage or turn-off voltage applied to the driver IC can be used as a reference signal to control the switching. A control method using the turn-off voltage as a reference signal is proposed here. As shown in the first embodiment of FIGS. 3 and 4, the turn-on voltage and the turn-off voltage are applied to or removed from the driver IC in accordance with a prearranged sequence.

Figure 5:
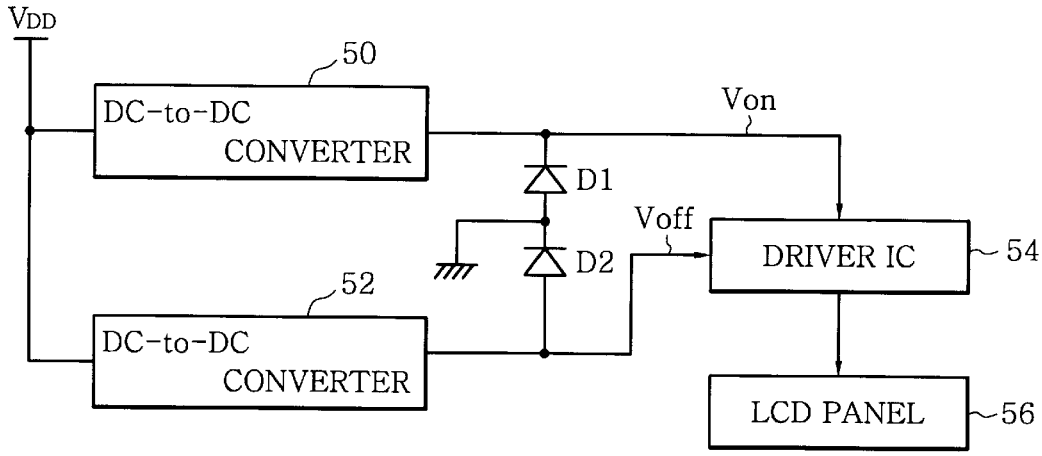
FIG. 5 is a block diagram showing a power supply of an LCD according to a second embodiment of the present invention.

Now referring to FIG. 5, a second embodiment of the present invention includes diodes for preventing a latch up of the gate driver IC.

In detail, the second embodiment includes DC-to-DC converters 50 and 52 to which the constant voltage $V_{DD}$ is applied. DC-to-DC converter 50 is connected to a driver IC 54 to apply the voltage Von. DC-to-DC converter 52 is also connected to the driver IC 54 to apply the voltage $V_{off}$. Driver IC 54 applies a driving voltage to an LCD panel 56. A diode D1 is connected in a reverse direction and in parallel to an output terminal of the DC-to-DC converter 50, and a diode D2 is connected in forward direction and in parallel to an output terminal of the DC-to-DC converter 52. The two diodes D1 and D2 are grounded in common.

Thus, when voltage $V_{DD}$ is applied to DC-to-DC converters 50 and 52, the DC-to-DC converter 52 applies voltage $V_{off}$ of −7V the DC-to-DC converter 52 to the driver IC 54, and the DC-to-DC converter 50 applies voltage $V_{on}$ of 20V to the driver IC 54.

In the meantime, an unstable current may flow to the driver IC 54 via the line through which the turn-off voltage $V_{off}$ is applied before the turn-off voltage $V_{off}$ is stabilized to −7V, which may result in a supply of an abnormal voltage. If the abnormal voltage reaches the latch up preventive level, the diode D2 is turned on so as to drop the voltage level down. Thus, the abnormal voltage which may generate a latch up is prevented from being applied to the driver IC 54.

The turn-on voltage $V_{on}$ is applied to the driver IC 54 after the turn-off voltage $V_{off}$ is applied. At this time, the unstable current may flow to the driver IC 54 via the line through which the turn-on voltage $V_{on}$ is applied, before the turn-on voltage $V_{on}$ is stabilized to 20V, which may result in a supply of the abnormal voltage to the driver IC 54. If the abnormal voltage reaches the latch up preventive level, the diode D1 is turned on, which raises the voltage level. Thus, the abnormal voltage which may generate a latch up is prevented from being applied to the driver IC 54.

In the embodiment shown in FIG. 5, the diode D1 can satisfy the requisite of $V_{on}>-0.5V$ and the diode D2 can satisfy the requisite of $V_{off}<0.5V$. Thus, a latch up of the driver IC 54 can be prevented.

Figure 6:
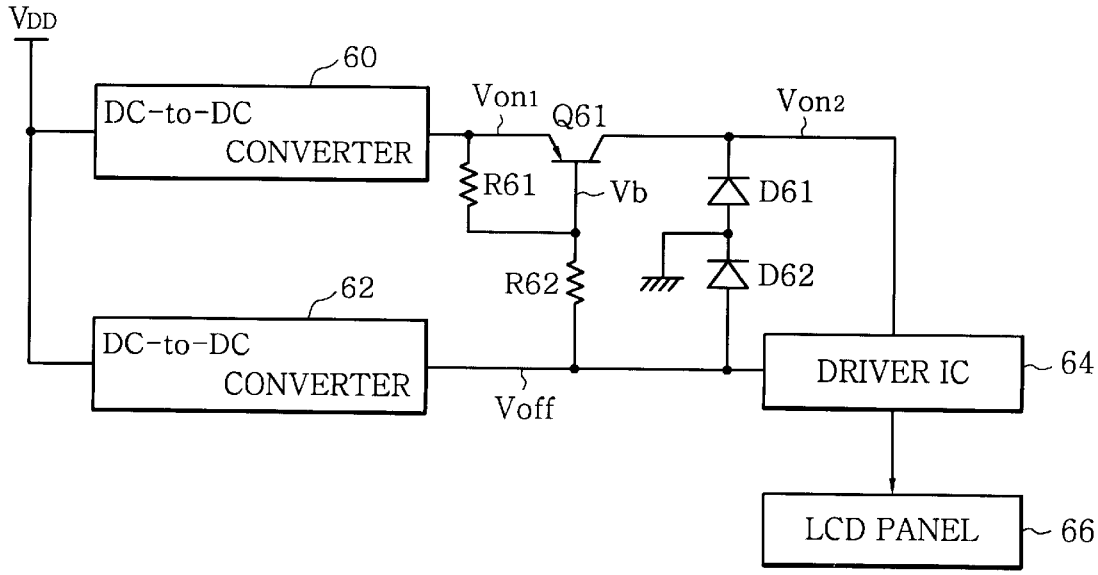
FIG. 6 is a block diagram showing a power supply of an LCD according to a third embodiment of the present invention.

Diodes for preventing a latch up of the gate driver IC can also be constituted as shown in FIG. 6.

Referring to FIG. 6, the constant voltage $V_{DD}$ is applied to DC-to-DC converters 60 and 62 which respectively output voltages $V_{on1}$ and $V_{off}$. A transistor Q61 converts voltage $V_{on1}$ to $V_{on2}$ when turned on by the turn-off voltage $V_{off}$. Then, the turn-off voltage $V_{off}$ of −7V is applied to the driver IC 64 before the turn-on voltage $V_{on2}$ is applied. The driver IC 64 generates a driving voltage by voltages $V_{on2}$ and $V_{off}$, and applies it to an LCD panel 66.

Diodes D61 and D62 are grounded in reverse and forward directions respectively to the portions of the driver IC 64 to which voltages $V_{on2}$ and $V_{off}$ are applied.

Thus, similarly to those shown in FIG. 5, diodes D61 and D62 remove the voltage that deviates from the latch up preventive condition. That is, diodes D61 and D62 prevent the abnormal voltage from being applied before voltages $V_{on2}$ and $V_{off}$ are stabilized to a normal level.

In the present invention, the diodes as shown in FIGS. 5 and 6 are employed as a latch up preventive device so as to prevent the voltage that violates the latch up preventive condition from being applied to the gate driver IC. Thus, an operation of the gate driver IC can be stabilized.

Schottky diodes can be used in the embodiments shown in FIGS. 5 and 6.

According to the present invention, voltages are applied to or removed from the gate driver in accordance with a prearranged sequence, which eliminates a latch up and stabilizes a driving of the LCD panel. Thus, a production yield for an LCD device can be enhanced while the product reliability is improved.

This invention has been described above with reference to the aforementioned embodiments. It is evident, however, that many alternative modifications and variations will be apparent to those having skills in the art in light of the foregoing description. Accordingly, the present invention embraces all such alternative modifications and variations falling within the spirit and scope of the appended claims.

What is claimed is:

1. A power supply of a liquid crystal display (LCD) comprising:

a first DC-to-DC converter for converting a level of a predetermined constant voltage and outputting a first voltage;

a second DC-to-DC converter for converting said level of said predetermined constant voltage and outputting a second voltage;

a switching device for switching said first voltage based on a level of said second voltage and outputting a converted third voltage; and a gate driver integrated circuit (IC) for determining said second voltage as a turn-off voltage and said third voltage as a turn-on voltage and outputting a signal for driving an LCD panel.

2. The power supply according to claim 1, wherein said switching device comprises of a switching element and voltage dividing resistances connected to a portion of said switching element to which voltages are applied, and wherein said first voltage is converted to said third voltage, switched in accordance with said level of said second voltage applied to a portion of said switching element to which a switching element control signal is input, and is output.

3. The power supply according to claim 2, wherein said switching element is a bipolar transistor.

4. The power supply according to claim 3, wherein said bipolar transistor is a pnp-type.

5. The power supply according to claim 4, wherein a potential difference caused by said voltage dividing resistances is set higher than a voltage drop between an emitter and a base of said bipolar transistor.

6. The power supply according to claim 2, wherein said switching element is a metal-oxide semiconductor (MOS) transistor.

7. The power supply according to claim 6, wherein said MOS transistor is a p-type.

8. The power supply according to claim 7, wherein a potential difference caused by said voltage dividing resistances is set higher than a threshold voltage of said MOS transistor.

9. The power supply according to claim 1, wherein said first and second DC-to-DC converters have independent time constants so that said second voltage is applied after said first voltage start s to be applied.

10. A voltage sequence control method of an LCD panel, comprising steps of:

generating a first voltage for turning on said LCD panel;

generating a second voltage for turning off said LCD panel; and applying said first voltage and said second voltage to a gate driver IC for outputting an on/off signal for driving said LCD panel, wherein a level and a timing for applying said first voltage are determined by switching said first voltage in accordance with a level of said second voltage.

11. The method according to claim 10, wherein said first voltage is applied to said gate driver IC after said second voltage is applied when an external power is applied to said LCD panel by switching said first voltage in accordance with said second voltage level;

wherein said second voltage is removed from said gate driver IC after said second voltage is removed when said LCD panel is turned off; and wherein such sequences are automatically controlled.

12. A power supply of a liquid crystal display (LCD) comprising:

a first DC-to-DC converter converting a level of a predetermined constant voltage and outputting a first voltage;

a second DC-to-DC converter converting said level of said predetermined constant voltage and outputting a second voltage;

a gate driver IC generating a driving voltage by said first and second voltages;

an LCD panel operated by said driving voltage; and a latch up preventive device maintaining a level of said first voltage higher than a predetermined first voltage value and maintaining a level of said second voltage lower than a predetermined second voltage value.

13. The power supply according to claim 12, wherein said latch up preventive device comprises of a first diode connected in reverse direction to a portion of said gate driver IC to which said first voltage is applied and a second diode connected in forward direction to a portion of said gate driver IC to which said second voltage is applied.

14. The power supply according to claim 13, wherein said first and second diodes are shottky diodes.

15. The power supply according to claim 13, wherein said predetermined first voltage value is –5V and said predetermined second voltage value is 5V.

16. A power supply of a liquid crystal display (LCD) comprising:

a first DC-to-DC converter for converting a level of a predetermined constant voltage and outputting a first voltage;

a second DC-to-DC converter for converting said level of said predetermined constant voltage and outputting a second voltage;

a switching device for switching said first voltage based on a level of said second voltage and outputting a converted third voltage;

a gate driver IC determining said second voltage as a turn-off voltage and said third voltage output from said switching device as a turn-on voltage and outputting a driving voltage;

an LCD panel operated by said driving voltage; and a latch up preventive device for maintaining a level of said third voltage higher than a predetermined first voltage value and maintaining a level of said second voltage lower than a predetermined second voltage value.

17. The power supply according to claim 16, wherein said latch up preventive device comprises of a first diode connected in reverse direction to a portion of said gate driver IC to which said first voltage is applied and a second diode connected in forward direction to a portion of said gate driver IC to which said second voltage is applied.

18. The power supply according to claim 17, wherein said first and second diodes are Schottky diodes.

* * * * *